US005618352A

United States Patent [19]

Ebeling et al.

[11] Patent Number: 5,618,352

[45] Date of Patent: Apr. 8, 1997

[54] CONTINUOUSLY OPERATING CENTRIFUGE FOR SPINNING SUGAR MASSECUITE

[75] Inventors: Ralf-Martin Ebeling; Helmut Schaper, both of Brunswick, Germany

[73] Assignee: Braunschweigische Maschinenbauanstalt AG, Brunswick, Germany

[21] Appl. No.: 500,581

[22] Filed: Jul. 11, 1995

[30] Foreign Application Priority Data

Jul. 15, 1994 [DE] Germany ..... 44 25 063.0

[51] Int. Cl.[6] ..... B04B 7/02; B04B 11/06

[52] U.S. Cl. ..... 127/19; 127/2; 127/9; 127/15; 494/63; 210/360.1

[58] Field of Search ..... 127/2, 9, 15, 19; 494/43, 63; 210/360.1, 367, 369, 380.1, 382, 391

[56] References Cited

U.S. PATENT DOCUMENTS

| | | | |
|---|---|---|---|
| 105,520 | 7/1870 | Tully | 127/19 |
| 157,595 | 12/1874 | Fesca | 127/19 |
| 2,099,963 | 11/1937 | Miller | 210/360.1 |
| 3,226,257 | 12/1965 | Steele et al. | 127/19 |
| 3,302,794 | 2/1967 | Laven | 210/369 |
| 3,490,947 | 1/1970 | Grieselhuber | 127/19 |
| 4,409,031 | 10/1983 | Schaper | 127/19 |
| 5,114,489 | 5/1992 | Milner et al. | 127/19 |
| 5,269,849 | 12/1993 | Milner | 127/2 |
| 5,281,275 | 1/1994 | Milner | 127/2 |
| 5,286,298 | 2/1994 | Milner et al. | 127/2 |
| 5,286,299 | 2/1994 | Milner | 127/17 |
| 5,368,541 | 11/1994 | Knelson | 494/37 |

FOREIGN PATENT DOCUMENTS

| | | | |
|---|---|---|---|
| 0050559 | 4/1982 | European Pat. Off. | B04B 7/04 |
| 0252341 | 1/1988 | European Pat. Off. . | |
| 0487780 | 6/1992 | European Pat. Off. | B04B 3/00 |
| 2563448 | 10/1985 | France . | |
| 2550496 | 5/1977 | Germany | B04B 15/12 |
| 2910625 | 9/1980 | Germany | B04B 15/12 |
| 2207663 | 4/1984 | Germany | B04B 11/02 |
| 9004952 | 10/1991 | Germany | B04B 9/00 |
| 1247279 | 9/1971 | United Kingdom . | |

*Primary Examiner*—Glenn A. Caldarola
*Assistant Examiner*—Patricia L. Hailey
*Attorney, Agent, or Firm*—W. G. Fasse; W. F. Fasse

[57] ABSTRACT

A continuously operating centrifuge for spinning sugar massecuite has a perforated basket which widens conically and rotates about a vertical axis. The perforated basket has a throwing-off edge from which the sugar particles are spun off outwardly and are then collected in a further processing device and undergo additional treatment. The further processing device has a removable collecting channel with at least one discharge nozzle at the base thereof. An overflow nozzle can be installed in the discharge nozzle to cause pooling of liquid and convert the centrifuge from magmatizing operation to dissolving operation. An adjustable rebound member and selectable one of two liquid medium conduits further allow reconfiguration between the two modes of operation. For dry centrifuging, the collecting channel can be removed.

21 Claims, 4 Drawing Sheets

Fig.8
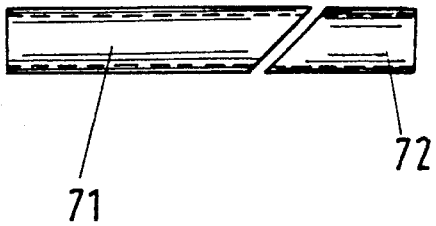
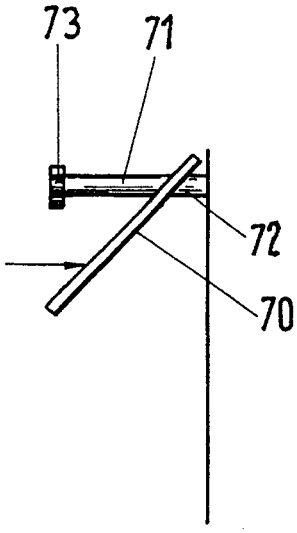
Fig.7
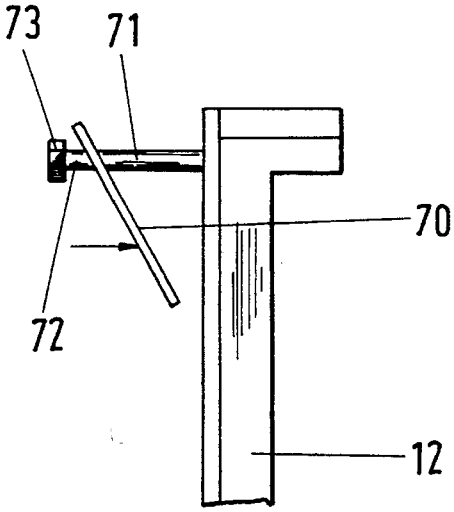
Fig.6
Fig.4
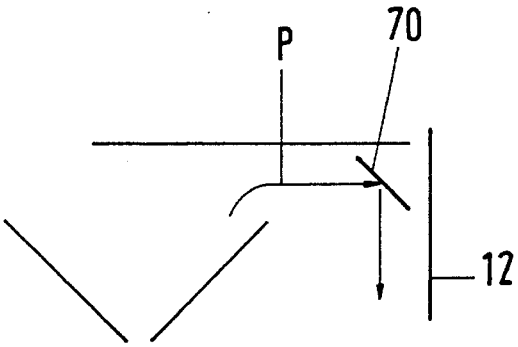
Fig.5
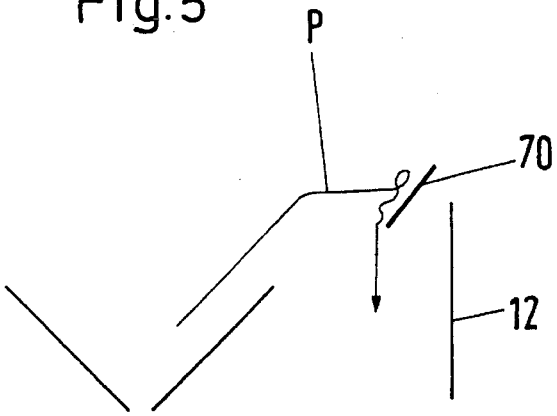

CONTINUOUSLY OPERATING CENTRIFUGE FOR SPINNING SUGAR MASSECUITE

FIELD OF THE INVENTION

The invention relates to a continuously operating centrifuge for spinning sugar massecuite, with a perforated basket which widens conically and rotates about a vertical axis and has a throwing-off edge from which the sugar particles are spun off outwardly and are then collected in a further processing device and undergo additional treatment.

BACKGROUND INFORMATION

Centrifuges of the above described general type are known, for example, from the foreign Patent Publications DE 22 07 663 C3, DE 25 50 496 A1, DE 90 04 952 U1 or EP 0 487 780 B1. In the conventional centrifuges, the sugar massecuite is firstly introduced into the central region of the centrifuge and is then guided by means of a distributing pot or in another manner into the narrower inner region of the perforated basket. In the course of this process, the massecuite is accelerated to a peripheral speed in the distributor or in an accelerating bell or a foreworker drum, and is then spun off outwardly.

The particles then reach the sugar narrow inner region, usually located at the bottom, of the perforated basket which widens conically upwards, and then "drift" slowly up the inner wall until they reach the throwing-off edge. Once they reach this edge they are spun off outwardly.

There are three variations of the above process in the state of the art. The centrifuges produce either, dissolved sugar, mingled sugar, or dry sugar, and are respectively operated as dissolving, magmatizing or dry centrifuges. In the first case, the separated and purified sugar crystals are re-dissolved in various ways. In the second case, a magmatizing process is additionally incorporated in which the crystals remain but the surrounding syrup coating is partially dissolved and is ultimately exchanged for a purer syrup coating. In the third case, the dry sugar crystals are discharged downwardly and conveyed away by means of a transporting device.

The three modes of operation each require different centrifuges, and it is not possible to take one centrifuge designed for one of these purposes and use it freely for another purpose. This means restricted flexibility for the user and disadvantages in terms of stock for the manufacturer.

It has therefore already been proposed, for example in German Patent Publications DE 90 04 952 U1 and DE 29 10 625 A1, to arrange two centrifuges one above another, for example one operating as a magmatizing centrifuge and the other as a dissolving centrifuge, in order to have both available in one constructional unit in a space-saving manner. This is advantageous but costly.

In contrast, to the above state of the art the object of the invention is to propose a continuously operating centrifuge for spinning sugar massecuite, which is suitable for a plurality of applications, i.e. which can be operated in more than one of the above described modes.

The object is achieved by the invention having the above mentioned perferated conical basket and further processing device, in that the further processing device has a collecting channel, preferably removable, with at least one discharge nozzle at the base, thereof and in that an overflow nozzle may selectively by installed at the discharge nozzle.

The special construction of the collecting channel allows the centrifuge of the invention to be used both as a magmatizing centrifuge and a dissolving centrifuge. Furthermore, the present centrifuge can be used as a drying centrifuge by simply removing the collecting channel.

For use as a dissolving centrifuge, the outlet of the collecting channel is blocked by putting on or installing the overflow nozzle. The dissolving medium, i.e. water and/or thin juice, and the sugar crystals that have already formed are collected and dissolved in the collecting channel. A mass of clarifying liquor is formed in the collecting channel because of the overflow nozzle, which has a dam effect that causes the liquid to pool-up to a certain level before it can drain through the outlet. Thus, a residence time is produced for subsequent dissolving.

Undissolved crystals will sink to the base of the collecting channel.

In order to also dissolve residual crystals as far as possible, i.e. during use as a dissolving centrifuge, it is preferred for at least one steam conduit to be arranged in the base region of the collecting channel inside the clarifying mass and for steam to be fed in. The steam conduit(s) can be removable so that they do not become encrusted during other modes of use.

The level of liquid rising above the overflow nozzle will then flow through the overflow nozzle into the discharge nozzle, from which the liquid can discharged and collected.

It is also possible to regulate the level of the mass of clarifying liquor by using different overflow nozzle heights. The overflow nozzle is preferably adjustable in height in a step-free manner, or nozzles of different heights can be used.

The dissolving centrifuge known, for example, from German Patent Publication DE 25 50 496 A1 also collects the spun-off sugar crystals, but not in a collecting channel. It could not be used as a magmatizing centrifuge as the viscous magma would clog up all the parts immediately.

In order for the centrifuge of the invention to function as a magmatizing centrifuge, the overflow nozzle is removed. The affining magma, which flows out very slowly in comparison to clarifying liquor, is then directly guided away without any danger of clogging. The magmatizing medium is preferably conveyed via an outer ring conduit to a rebounding surface which is formed by or projects from the wall of the collecting channel remote from the perforated basket. A layer of the magmatizing medium thus spreads over the rebounding surface and the spun-off sugar crystals penetrate the layer.

The further processing equipment preferably surrounds the perforated basket in an annular way. This ensures that further processing of the sugar crystals is uniform in all applications.

Provision is also preferably made for a supply device, particularly a ring conduit, to supply the dissolving medium in the region of the throwing-off edge of the perforated basket especially for operation in the dissolving mode. The said ring conduit extends at a relatively small distance above the throwing-off edge and sprays the dissolving medium or delivers it in another way to the sugar crystals which are spun off in this region. The rotating drum of the perforated basket causes the solvent to be strongly agitated and it is thrown together with the sugar crystals tangentially away from the perforated basket and over the collecting channel towards a rebounding surface positioned behind the channel. The agitation promotes the dissolving effect even during the throwing process, and brings about uniform distribution of the sugar crystals and the dissolving medium. The sugar crystals and dissolving medium then slide off the rebounding surface down into the collecting channel, which has already been filled with dissolving medium and sugar crystals dissolved therein during operation of the apparatus. During the static residence time, the sugar crystals dissolve further inside the said channel and the clarifying liquor then flows through the overflow nozzle into the discharge nozzle.

It is possible to allow the collecting channel to extend in an annular form as a continuous channel around the perforated basket. However, it is preferred for the further processing device to have a plurality of collecting channels which each have at least one discharge nozzle at the base thereof, whereby provison is made for overflow nozzles of the discharge nozzles. This allows more specific access and more precise determination of the respective products in terms of quantity.

It is particularly preferable for oblique surfaces to be arranged between each two adjacent collecting channels, ensuring that particles lying thereon will slip into the neighbouring collecting channel.

In case that in many applications stray particles form above the further processing device. It should also be taken into account that the spun-off sugar crystals and adhering syrup residue are spun off tangentially, not radially, and have corresponding displacement components.

It is possible to group the plurality of collecting channels in succession in the peripheral direction around the perforated basket. However, it is particularly preferable for the further processing device, surrounding the perforated basket in an annular form, to have a serrated profile, i.e. a bottom made up of stepped, sloped bottom sections, when seen in a section at a constant distance from the axis of the perforated basket, the discharge nozzles being arranged at the deepest points of the profile.

This means that the collecting channels, when seen from the interior of the perforated basket, are each arranged next to one another like basins, each at the same distance from the axis of the perforated basket, and each separated from one another or connected to one another by oblique surfaces.

The collecting channels and the oblique surfaces positioned therebetween (arranged with even their highest points below the throwing-off edge of the perforated basket) are closed towards the outside by a rebounding wall.

BRIEF DESCRIPTION OF THE DRAWINGS

One example embodiment of the invention will now be described in detail with reference to the drawing, wherein.

FIG. 4 is a schematic section showing the function of a rebounding member in a magmatizing centrifuge;

FIG. 5 is a schematic section showing the function of a rebounding member in a dissolving centrifuge;

FIG. 6 is an enlarged detail of FIG. 4 with a rebounding cone portion;

FIG. 7 is an enlarged detail of FIG. 5 with a rebounding cone portion; and FIG. 8 is a schematic illustration of an assembly unit for the rebounding cone portion.

DETAILED DESCRIPTION OF PREFERRED EXAMPLE EMBODIMENTS AND OF THE BEST MODE OF THE INVENTION

Figure 1:
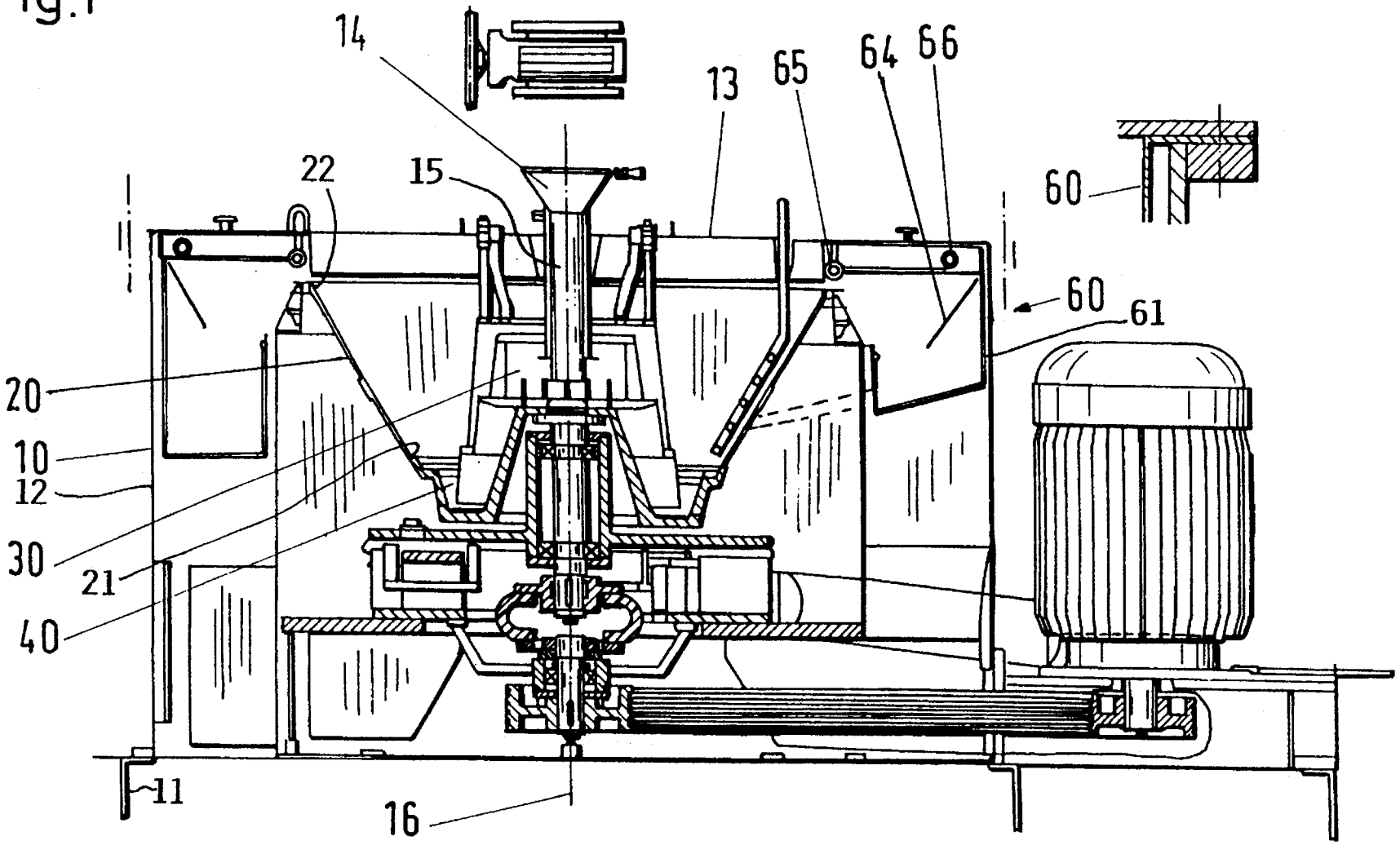
FIG. 1 is a schematic section through an embodiment of a centrifuge according to the invention.

The centrifuge shown in FIG. 1 has a fixed housing 10 with a base 11, side walls 12, a cover 13 above the actual perforated basket 20, and a filling funnel 14. The sugar massecuite falls through the filling funnel 14 and a shaft 15 which is also stationary, into a distributing pot 30.

The perforated basket 20, the distributing pot 30 and a product distributor 40 rotate about a common vertical axis 16.

The sugar massecuite put into the filling funnel 14 is conveyed through the distributing pot 30 and the product distributor 40 and is accelerated to the peripheral speed of the product distributor.

The massecuite subsequently reaches the throwing-off edge of the lowermost member of the product distributor 40, and from there is spun off outwardly, where it reaches the lower region of the rebounding surface 21 of the perforated basket 20, which widens conically upwards. From this point it reaches a sieve securely connected to the base of the basket and the rebounding surface 21, and because of the centrifugal force drifts upwards over the screen.

The perforated basket 20 ends at the top in a throwing-off edge 22 which rotates at a known speed together with the perforated basket. The sugar particles are spun off outwardly from the throwing-off edge 22 and are collected and additionally treated in a further processing device 60.

Figure 3:
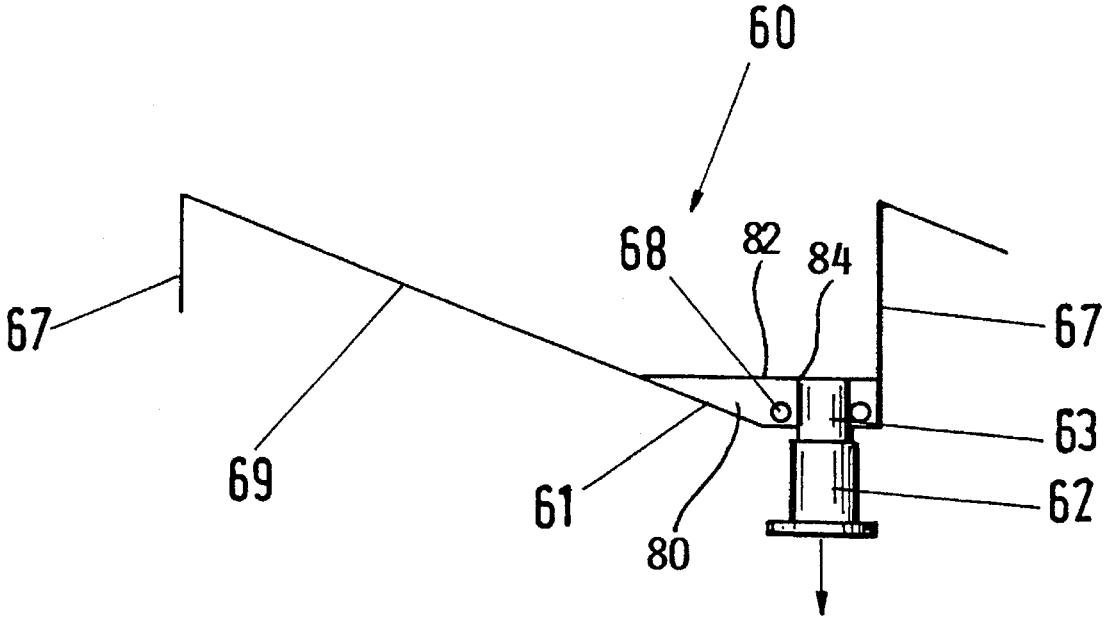
FIG. 3 is an enlarged section through the collecting-channel region of the centrifuge.

The present embodiment relates to a particular configuration of the centrifuge for use as a dissolving centrifuge. In this embodiment, a ring conduit 65 is located above the throwing-off edge 22. The ring conduit 65 sprays a dissolving medium into the region located slightly therebelow, from which the sugar crystals are spun off outwardly. The ring conduit is stationary and does not rotate with the throwing-off edge 22; however, the dissolving medium is strongly agitated by the rotating drum and the moving sugar crystals and thus is mixed with the said sugar crystals. The dissolving medium is thrown off outwardly together with the sugar crystals, namely through the further processing device 60 over a collecting channel 61 towards a removable rebounding surface 64 which projects upwardly from the collecting channel 61 in the form of a wall thereof remote from the perforated basket. The dissolving medium, particularly water and/or thin juice together with sugar crystals which have already partially dissolved therein, then slides off the rebounding surface 64 into the collecting channel 61. Dissolving medium and sugar crystals will already have collected in the channel. As shown especially in FIG. 3, collecting channel 61 has a discharge nozzle 62 which, in the illustrated example, is blocked by an overflow head tube or nozzle 63. Thus liquid accumulates as a mass of clarifying liquor 80 until it reaches a level 82 just above the top edge 84 of the overflow nozzle 63 and can then flow over the edge 84 into the overflow nozzle 63 and from there downwards into the discharge nozzle 62.

Figure 2:
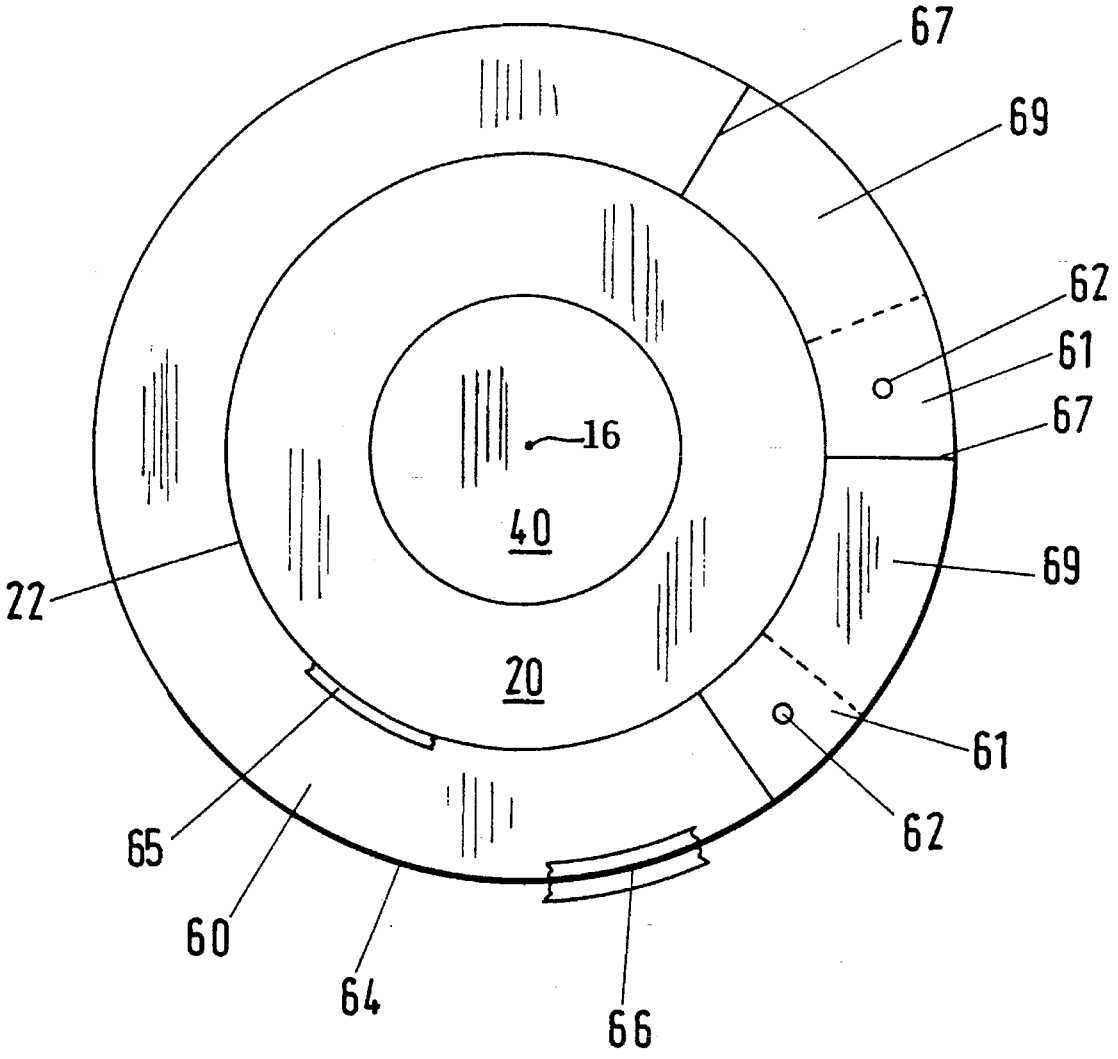
FIG. 2 is a plan view of a centrifuge with the further processing device.

The further processing device 60 surrounds the perforated basket 20 in an annular way as show especially in the plan view of FIG. 2. A plurality of basin-like collecting channels 61 are provided and together form the annular further processing device 60. It shoud be understood that FIG. 2 simply schematically shows two of several collecting channels. Each of the collecting channels 61 is approximately the same size and at the same distance from the axis 16 of the perforated basket. The discharge nozzle 62 is located at the deepest or lowest point of the bottom of each collecting channel 61. On one side a delimiting wall 67 projects up from the collecting channel, and on the other side an oblique surface 69, which is considerably less steep than wall 67, but extends in a sufficiently oblique manner, slopes upward in the direction of the adjacent collecting channel 61 and is connected at that point to the steep delimiting wall or side 67 projecting from the adjacent channel.

The oblique surfaces make it possible for the particles coming to rest thereon to slide into the collecting channels, yet at the same time they increase the average residence time of the particles in this region.

A steam conduit 68 extends in the base region of the collecting channel 61. Steam can be conveyed therefrom into the clarifying mass in order to further improve the dissolution. The steam conduit 68 can be removed in order to prevent clogging and encrusting when the centrifuge is being used as a magmatizing centrifuge.

As mentioned above, the preceding discussion describes use of the centrifuge of the invention as a dissolving centrifuge.

If the centrifuge is to be used for magmatizing, the overflow nozzles 63 are removed and the steam conduit 68 may be removed. The supply of dissolving medium through the ring conduit 65 is also halted.

Instead, a magmatizing medium is introduced through a second ring conduit 66. This second outer ring conduit 66 surrounds the perforated basket 20 and the other, i.e. first or inner, ring conduit 65 concentrically. The conduit 66 extends substantially above the rebounding surface 64 and releases magmatizing medium. Thus a layer of the magmatizing medium spreads over the rebounding surface 64, which in this case is installed or adjusted so as to be inclined downwardly in the outwards direction (see e.g. FIGS. 4 and 6). The sugar crystals, spun off from the throwing-off edge 22 and in this instance not acted upon with dissolving medium, pass into the layer of magmatizing medium. As the sugar crystals pass into the medium they are evenly distributed and at the same time subjected to a relative movement with regard to the magmatizing medium. The magmatizing medium also prevents the sugar crystals from bursting, which would be particularly disadvantageous in this mode of operation.

Thus the sugar crystals and the magmatizing medium slide slowly in the direction of the discharge nozzle or nozzles 62 of the collecting channel 61 in the further processing device 60. The very slow-flowing affination magma thus formed flows without formation of a mass through the discharge nozzle (s) 62, i.e. without being dammed-up by the overflow nozzle 63, which has been removed.

The reduced speed of the movement process is further promoted by the oblique surface between the collecting channels 61. In statistical terms a substantial proportion of the magmatizing medium and the embedded sugar crystals does not slide straight from the rebounding surface 64 into the collecting channel 61, but rather first slides onto the oblique surface 69 and then from there passes slowly in the direction of the discharge nozzle 62.

It should be further stressed that the two preferred ring conduits 65 and 66 bring about very different results and are each used for one of the two possible applications, namely the dissolving centrifuge or the magmatizing centrifuge, and they also deliver very different media during their respective application.

In this very simple manner the same centrifuge can be used for magmatizing and for dissolving; the additional components provided (a second ring conduit, a special profile for the further processing device and various discharge nozzles) are not of any great importance.

The further processing device 60 with the collecting channel 61 at its core is produced as a constructional unit, i.e. a single structural unit, which can be easily installed or removed. It can be suspended in the frame 10—a standard housing—and can be secured between the flange of the housing and the cover 13. It can be removed at any time if the centrifuge is to be used to discharge dry sugar, i.e. is not to be used as either a magmatizing or a dissolving centrifuge. Thus without needing large-scale or complicated modification, the same centrifuge can be used for a third application with an entirely different field of use.

The preferred embodiment of the centrifuge is also fitted with an adjustable rebounding cone portion 70 in order to further optimise the rebounding surface 64. The cone serves to better adapt the centrifuge to different requirements. The basic physical principles are schematically illustrated in FIGS. 4 and 5. for example in the case of a magmatizing centrifuge, the sugar crystals or particles P are to be transferred relatively carefully or gently into the magmatizing medium from their horizontal movement after spinning off. In that case it is advantageous if, in order to achieve downwards deflection by 90° or approximately 90°, a cone portion is provided to rotate radially above the collecting channel, the pitch of the cone being oriented inwardly, i.e. the virtual apex of the cone would be above the centrifuge as shown in FIG. 4.

The intention is the opposite in a dissolving centrifuge. In this case the sugar crystals are to be dissolved and broken up. Surprisingly, a layout can be provided to reinforce this effect. FIG. 5 shows a rebounding cone portion 70 with a virtual cone apex below the centrifuge. Particles P reaching the surface, which rises obliquely outwardly, are diverted upwards and slide upwards over the inclined surface against the force of gravity, then slide downwards again and thus collide head-on with the next batch of particles P reaching the surface. The the result is a continuous thorough mixing with further particles P which have been brought to an abrupt halt, until they fall into the collecting channels 61.

The above described different rebound members with opposite effects can be provided by a simple modification. The rebounding cone portion 70 is simply removed and re-installed the other way around i.e. upside down. Installation takes place using two movable spacer sleves or pipe portions 71, 72 which are cut obliquely from the same pipe so as to fit together, taking into account the pitch of the rebounding cone portion 70 as shown in FIG. 8. The cone portion 70 contains bores which extend horizontally when in an assembled position. A bolt or screw 73 is inserted through the two pipe portions 71, 72 and the bore in the interposed rebounding cone portion 70, and is secured horizontally in the outer wall of the collecting channel 61 or the side wall 12 of the frame 10.

Adaptation from a dissolving centrifuge to a magmatizing centrifuge or vice versa merely requires swapping the relative positions of the longer spacer sleeve 71 and the shorter spacer sleeve 72, and turning over the rebounding cone portion 70, as seen by comparing FIGS. 6 and 7.

Although the invention has been described with reference to specific example embodiments, it will be appreciated that it is intended to cover all modifications and equivalents within the scope of the appended claims.

We claim:

1. A continuously operable centrifuge for spinning sugar massecuite that is convertible to operate in a selected one of a dissolving mode and a magmatizing mode, comprising a perforated basket which widens conically, is adapted to rotate about a vertical axis and has a throwing-off edge from which sugar particles can be spun off outwardly, and a further processing device in which said sugar particles can be collected and further processed, wherein said further processing device comprises a collecting channel with at least one discharge nozzle arranged at a bottom of said channel, and a removable overflow nozzle that is arranged at said discharge nozzle in said dissolving mode.

2. The centrifuge in accordance with claim 1, wherein said further processing device annularly surrounds said perforated basket.

3. The centrifuge in accordance with claim 1, wherein said further processing device comprises a plurality of said collecting channels and each of said channels has at least one said discharge nozzle at said channel bottom, and a plurality of said removable overflow nozzles to cooperate with said discharge nozzles.

4. The centrifuge in accordance with claim 3, wherein said collecting channels comprise oblique sloping surfaces arranged between each two adjacent ones of said collecting channels, and said oblique sloping surfaces have a sufficient slope so that sugar particles coming to rest thereon will slide into said adjacent collecting channel.

5. The centrifuge in accordance with claim 4, wherein said collecting channels have a serrated profile at least partially formed by said oblique surfaces when seen in cylindrical section, and wherein said discharge nozzles are respectively arranged in said collecting channels at respective deepest points of said profile.

6. The centrifuge in accordance with claim 1, wherein said further processing device comprises a rebounding wall arranged at a side of said collecting channel remote from said perforated basket, and a supply device for a magmatizing medium arranged and adapted to deliver said medium to said rebounding wall.

7. The centrifuge in accordance with claim 1, further comprising a supply device for a dissolving medium is arranged proximate said throwing-off edge.

8. The centrifuge in accordance with claim 6, wherein said supply device comprises a ring conduit.

9. The centrifuge in accordance with claim 1, further comprising a steam conduit arranged in said collecting channel adjacent to said discharge nozzle in said dissolving mode.

10. The centrifuge in accordance with claim 1, wherein said overflow nozzle comprises a height-adjustable member with a height-adjustable overflow hole.

11. The centrifuge in accordance with claim 1, wherein said centrifuge is further convertible to selectively operate in a dry mode, and wherein said further processing device is an independent structural unit that is removably arranged in said centrifuge.

12. The centrifuge in accordance with claim 1, further comprising a rebounding cone portion arranged above said collecting channel to divert said outwardly spun off particles.

13. The centrifuge in accordance with claim 12, wherein said rebounding cone portion is removable and is adapted and configured so that it can be installed selectively in a first orientation with said cone portion sloping downward and radially outward and in a second orientation inverted relative to said first orientation with said cone portion sloping downward and radially inward.

14. The centrifuge in accordance with claim 13, further comprising first and second pipe stubs having complementary sloped end faces arranged to receive and hold said rebounding cone portion therebetween.

15. The centrifuge in accordance with claim 7, wherein said supply device comprises a ring conduit.

16. The centrifuge in accordance with claim 6, wherein said rebounding wall is removably mounted in said centrifuge.

17. The centrifuge in accordance with claim 1, comprising a set of a plurality of said overflow nozzle, wherein individual ones of said plural overflow nozzles respectively have different dimensions, and wherein a selected one of said nozzles having a selected dimension is arranged at said discharge nozzle.

18. A centrifuge system that can be configured and reconfigured into any selected one of a dissolving centrifuge configuration and a magmatizing centrifuge configuration for continuously spinning sugar massecuite, said system comprising a rotatably supported perforated centrifuge basket having a sugar particle throw-off edge at a sugar outlet end of said basket, and a sugar processing device arranged radially outwardly from said throw-off edge, wherein said sugar processing device comprises a liquid collecting channel with a channel bottom, and a selectable liquid outflow device including a selectable discharge outlet near said channel bottom and a selectable overflow outlet above said discharge outlet, wherein said discharge outlet is selected and is open for direct liquid outflow therethrough only in said magmatizing centrifuge configuration, and wherein said overflow outlet is selected and is open for liquid outflow therethrough in said dissolving centrifuge configuration.

19. The centrifuge system in accordance with claim 18, wherein said selectable liquid outflow device includes a discharge hole through said channel bottom forming said discharge outlet, and a removable weir mender that includes said overflow outlet at an upper end thereof and that is selectively installed over said discharge hole in said dissolving centrifuge configuration.

20. The centrifuge system in accordance with claim 18, further comprising a first radially inner conduit arranged above said throw-off edge in proximity thereto for supplying a dissolving medium in said dissolving centrifuge configuration, a second radially outer conduit arranged radially outwardly from said first conduit for supplying a magmatizing medium in said magmatizing centrifuge configuration, and a rebound member that is arranged radially outwardly from said throw-off edge and that has a selected first rebound slope sloping upward and radially outward in said dissolving centrifuge configuration and has a selected second rebound elope sloping downward and radially outward in said magmatizing centrifuge configuration.

21. The centrifuge system of claim 18, which further can be configured and reconfigured into a dry centrifuge configuration, wherein said sugar processing device is removably arranged radially outwardly from said throw-off edge and is adapted to be removed for said dry centrifuge configuration.

* * * * *

UNITED STATES PATENT AND TRADEMARK OFFICE
CERTIFICATE OF CORRECTION

PATENT NO. : 5,618,352

DATED : Apr. 8, 1997

INVENTOR(S) : Ebeling et al.

It is certified that error appears in the above-identified patent and that said Letters Patent is hereby corrected as shown below:

On the Title Page: In "References Cited U. S. PATENT DOCUMENTS", replace "2,099,963" by --2,099,863--.

In Col. 1, line 28, after "The" insert --sugar--, after "the" delete --sugar--.
line 34, delete ",";
between lines 55 and 56, insert --SUMMARY OF THE INVENTION--;
line 63, replace "perferated" by --perforated--;
line 66, delete ",", after "thereof" insert --,--.
Col. 2, line 27, after "can" insert --be--.
Col. 3, line 6, delete "said";
line 13, after "nozzles" insert --to be selectively installed at each--;
line 21, delete "case that".
line 44, replace "towards" by --toward--.
Col. 4, line 59, replace "show" by --shown--;
line 62, replace "shoud" by --should--.
Col. 5, delete the paragraph spacing between lines 20 and 21.
Col. 6, line 21, replace "for" by --For--;
line 49, replace "sleves" by --sleeves--;
delete the paragraph spacing between lines 58 and 59.
Col. 8, line 40, replace "mender" by --member--;
line 55, replace "elope" by --slope--.

Signed and Sealed this

Sixteenth Day of September, 1997

*Attest:*

Bruce Lehman

BRUCE LEHMAN

*Attesting Officer*

*Commissioner of Patents and Trademarks*